US006095637A

United States Patent [19]

Hirabayashi et al.

[11] Patent Number: 6,095,637

[45] **Date of Patent: *Aug. 1, 2000**

[54] RECORDING APPARATUS AND METHOD FOR GRADATION RECORDING IN DIVIDED OR OVERLAPPED REGIONS OF A RECORDING MEDIUM

[75] Inventors: Hiromitsu Hirabayashi, Irvine, Calif.; Tetsurou Inoue, Tokyo, Japan; Akitoshi Yamada, Irvine, Calif.

[73] Assignee: Canon Kabushiki Kaisha, Tokyo, Japan

[ * ] Notice: This patent is subject to a terminal disclaimer.

[21] Appl. No.: 08/901,648

[22] Filed: Jul. 28, 1997

[30] Foreign Application Priority Data

Jul. 30, 1996 [JP] Japan ..... 8-200303
Jul. 30, 1996 [JP] Japan ..... 8-200834

[51] Int. Cl.[7] ..... B41J 2/15; B41J 2/21

[52] U.S. Cl. ..... 347/43; 347/40; 347/41; 400/82

[58] Field of Search ..... 347/12, 17, 43, 347/37, 41, 40; 400/17, 279, 82

[56] References Cited

U.S. PATENT DOCUMENTS

| | | | |
|---|---|---|---|
| 4,131,898 | 12/1978 | Gamblin | 347/41 |
| 4,272,771 | 6/1981 | Furukawa | 347/12 |
| 4,576,490 | 3/1986 | Isobe | 400/82 |
| 4,686,538 | 8/1987 | Kouzato | 347/15 |
| 5,594,475 | 1/1997 | Komakine et al. | 347/40 |
| 5,633,663 | 5/1997 | Matsubara et al. | 347/41 |
| 5,683,188 | 11/1997 | Miyazaki et al. | 347/41 |
| 5,696,542 | 12/1997 | Matsubara et al. | 347/12 |
| 5,749,662 | 5/1998 | Shibasaki et al. | 400/82 |
| 5,788,385 | 8/1998 | Inoue et al. | 400/279 |

FOREIGN PATENT DOCUMENTS

| | | |
|---|---|---|
| 0678388 | 10/1995 | European Pat. Off. . |
| 57-98363 | 6/1982 | Japan . |
| 1-221251 | 9/1989 | Japan . |
| 50-81437 | 7/1995 | Japan . |

*Primary Examiner*—N. Le
*Assistant Examiner*—Lamson D. Nguyen
*Attorney, Agent, or Firm*—Fitzpatrick, Cella, Harper & Scinto

[57] ABSTRACT

A recording apparatus is provided for performing recording of an image on a recording medium using a plurality of recording heads disposed at a predetermined interval in a scanning direction. The recording apparatus includes a scanning element for causing the plurality of recording heads to scan corresponding divided recording regions of an entire recording region of the recording medium. The entire recording region is divided into the recording regions in the scanning direction. The recording apparatus also includes a recording control element for causing the plurality of recording heads to perform one of recording in a first recording mode and a second recording mode when the scanning element causes the plurality of recording heads to scan the corresponding divided recording regions. In the first recording mode the recording control element causes at least two of the plurality of recording heads to perform recording of respective portions of an image on respective divided recording regions of the entire recording region. In the second recording mode the recording control element causes at least two of the plurality of recording heads to perform overlapped recording of at least a portion of an image on an overlapped recording region of the entire recording region.

26 Claims, 8 Drawing Sheets

RECORDING APPARATUS AND METHOD FOR GRADATION RECORDING IN DIVIDED OR OVERLAPPED REGIONS OF A RECORDING MEDIUM

BACKGROUND OF THE INVENTION

1. Field of the Invention

This invention relates to a serial image recording apparatus for recording characters, images or the like on a recording medium by scanning it with a recording head in a state in which the recording head faces the recording medium. More particularly, the invention relates to a shuttle-type recording apparatus in which a plurality of recording heads disposed at a predetermined interval can perform recording on corresponding ones of divided recording regions.

The invention is particularly suitable for use with a recording apparatus for performing recording by providing the surface of a recording medium with color materials based on image data, and is more suitable for an ink-jet recording apparatus for performing recording by discharging recording ink liquids as the color materials.

The present invention can be applied to all apparatuses which use a paper, a cloth, a leather, a nonwoven fabric, an OHP (overhead projector) sheet, a metal or the like as a recording medium. These apparatuses include, for example, business machines, such as printers, copiers, facsimile apparatuses and the like, and apparatuses for industrial production.

2. Description of the Related Art

A serial recording method in which recording is performed by scanning the surface of a recording medium with a recording head is widely used for various kinds of recording apparatuses because, for example, it is less expensive than a recording method using a full-line head which covers the entire width of a recording medium, such as recording paper or the like.

As serial recording apparatuses for coloring color materials in a recording medium, apparatuses for causing heating elements of a thermal print head to operate on dedicated thermosensitive paper, and apparatuses for performing recording by optically coloring dedicated photosensitive paper are known. Various methods for performing recording by providing a recording medium with color materials using a recording head have been practically used or proposed. Such methods include, for example, an impact recording method for causing an ink ribbon, in which an ink liquid is impregnated as a color material, to be in pressure contact with a recording medium by printing wires, a heat fusion transfer recording method or a heat sublimation transfer method for transferring ink by causing heating elements of a thermal print head to operate on an ink-ribbon head coated with a solid color material, and an ink-jet method for performing recording by discharging a recording ink liquid.

Recently, from the viewpoint of performing recording on ordinary paper, the recording method for providing color materials is mainly adopted. Particularly, the ink-jet recording method has advantages, such as low noise, low running cost, the capabilities of providing a small apparatus and recording on ordinary paper, the ease of color printing, and the like, and is generally used in recording apparatuses, such as printers, copiers and the like.

In the serial recording method, a recording head having recording elements, such as discharging ports or the like, capable of performing recording only within a relatively small range is disposed on a carriage and recording is performed by sequentially scanning a recording medium with the head. Hence, it is rather difficult to increase the recording speed, and high-speed printing has been a task for the serial recording method.

In order to increase the speed of image recording, various attempts have been proposed and practically used, such as an attempt to increase the recording width of a recording head (the range of arrangement of recording elements), an attempt to shorten the scanning time by increasing the speed of the carriage and the recording frequency, and an attempt to perform recording by bidirectional scanning. However, all of such methods have their limitations. For example, in order to increase the recording width, it is necessary to improve accuracy in the production of the head, thereby increasing the cost of the recording head, and the capacity of a printing buffer for temporarily storing recording data increases, thereby increasing the cost of the apparatus. Hence, such an approach is disadvantageous from the viewpoint of the cost.

In the method of causing coloration utilizing heat and in the method of providing color materials, particularly when the recording width is large, the necessity of means for preventing degradation of recording quality and the damage of the recording head due to the self heating of the recording head increases. In the ink-jet recording method of using a recording ink liquid from a recording head that does not contact a recording medium, if a recording head having a large recording width is used, complicated means for preventing degradation of recording quality due to undulation (cockling) of the recording medium caused by absorption of water in the ink is required. When increasing the recording frequency, it is necessary to increase the scanning speed of the carriage in order to maintain a certain pixel density. In such a case, the load of a driving source increases, and there is the possibility that recording quality is degraded due to oscillation of ink within the recording head caused by high-speed scanning of the carriage.

A relatively effective method for increasing the speed of a serial image recording apparatus is disclosed, for example, in Japanese Patent Laid-Open Application (Kokai) No. 50-81437 (1975) (U.S. Pat. No. 4,272,771). In this application, in order to simultaneously performing printing on left half and right half portions of a printing line, a left-side print head assembly and a right-side print head assembly supported by a carriage mechanism are used, thereby substantially doubling the printing speed. This application also states that a higher recording speed can be realized by increasing the number of the print head assemblies to at least three or by performing bidirectional recording.

However, in most of the conventional approaches disclosed in the above-described application and the like, the recording region is divided from the viewpoint of performing high-speed recording. Accordingly, a configuration in which an overlapped region where a plurality of heads perform scanning in an overlapped state is positively taken into consideration has not been disclosed. From the viewpoint of high-speed recording, an overlapped recording region must be removed as much as possible.

When performing recording on divided recording regions by taking respective shares in recording by a plurality of heads, recording on a sheet of a relatively large size can be performed at a high speed. Even in such a case, however, it is desirable to minimize the size of the apparatus.

SUMMARY OF THE INVENTION

It is an object of the present invention to provide a recording apparatus which can obtain a large-size recorded image as well as a small-size recorded image having a recording quality level different from that of a large-size image.

It is another object of the present invention to provide a recording apparatus which can switch between high-speed recording for a large-size recording region and high-quality gradation recording for a small-size recording region.

It is still another object of the present invention to provide a recording apparatus which can effectively utilize an image-data memory.

It is yet another object of the present invention to provide a recording apparatus in which recording is performed on corresponding divided recording regions by taking respective shares in recording by a plurality of recording heads, and recording is performed on a common overlapped recording region shared by the divided recording regions by the cooperation of the recording heads, without increasing the size of the apparatus.

It is yet a further object of the present invention to provide a recording apparatus which can appropriately perform discharge recovering processing of each recording head by appropriately arranging a plurality of recording heads having different density values of ink liquids to be discharged.

According to one aspect of the present invention, a recording apparatus for performing recording of an image on a recording medium using a plurality of recording heads disposed at a predetermined interval in a scanning direction is provided. The recording apparatus includes a scanning element for scanning a plurality of recording heads relative to corresponding divided recording regions of an entire recording region of a recording medium, the entire recording region being divided into the divided recording regions in a scanning direction. The recording apparatus further includes a recording control element for controlling the plurality of recording heads to perform one of recording in a first mode and a second recording mode when the scanning element scans the plurality of recording heads relative to the corresponding divided recording regions. In the first recording mode the recording control element controls at least two of the plurality of recording heads to perform recording of respective portions of an image on respective divided recording regions of the entire recording region. In the second recording mode the recording control element controls at least two of the plurality of recording heads to perform overlapped recording of at least a portion of an image on an overlapped recording region of the entire recording region.

In another aspect of the present invention, a recording method for performing recording of an image on a recording medium using a plurality of recording heads disposed at a predetermined interval in a scanning direction is provided. The recording method includes the step of scanning a plurality of recording heads relative to corresponding divided recording regions of an entire recording region of a recording medium, the entire recording region being divided into the divided recording regions in the scanning direction. The recording method further includes the steps of controlling the plurality of recording heads to perform one of recording in a first recording mode and a second recording mode during the scanning step. In the first recording mode at least two of the plurality of recording heads are controlled to perform recording of respective portions of an image on respective divided recording regions of the entire recording region. In the second recording mode at least two of the plurality of recording heads are controlled to perform overlapped recording of at least a portion of an image on an overlapped recording region of the entire recording region.

In yet another aspect of the present invention, a recording apparatus for performing recording on a recording medium using a plurality of recording heads for discharging liquid inks having different density values is provided. The recording apparatus includes a carriage for mounting a plurality of recording heads having ink discharging parts. A first recording head discharges ink having a first density and disposed near an end portion of said carriage. The recording apparatus also includes a scanning element for causing the plurality of recording heads to scan corresponding divided recording regions of an entire recording region of a recording medium, wherein the entire recording region is divided into the divided recording regions in a scanning direction. The recording apparatus further includes a recording control element for controlling the plurality of recording heads to perform one of recording in a first recording and a second recording mode when the scanning element scans the plurality of recording heads relative to the corresponding divided recording regions. In the first recording mode the recording control element controls at least two of the plurality of recording heads to perform recording of respective portions of an image on respective divided recording regions of the entire recording region. In the second recording mode the recording control element controls at least two of the plurality of recording heads to perform overlapped recording of at least a portion of an image on an overlapped recording region of the entire recording region.

According to the above-described configuration, by performing recording by a plurality of recording heads on corresponding divided recording regions by taking respective shares in recording, a large-:size recorded image can be obtained, and by utilizing an overlapped recording region where a plurality of recording heads perform scanning in an overlapped state, a small-size recorded image can be obtained by the cooperation of the plurality of recording heads, so that different recording quality levels can be obtained. Accordingly, by combining different recording density values recorded by a plurality of recording heads, recording having different recording sizes and gradation values and the like can be performed.

Since the ratios of the sizes of the respective regions and the gradation values can be appropriately determined, a memory for driving data shared by the respective recording modes can be effectively used.

Furthermore, according to the above-described configuration, in the arrangement of the recording heads in the carriage, a head for discharging ink having a higher density value is disposed at an end portion. Hence, the head at the end portion can be placed at the outside of the maximum recording region, so that the head can perform preliminary discharging during recording. On the other hand, a head discharging ink having a lower density value is, in some cases, always placed at a position facing the recording medium during recording. Even in this case, however, since the density of a dye or the like is low, the degree of an increase in the viscosity is small, and therefore no problem arises.

Since a suctioning unit is provided at a position within the overlapped recording region where the divided recording regions of all of the recording heads overlap, recoverying processing can be performed at a predetermined timing.

The foregoing and other objects, advantages and features of the present invention will become more apparent from the following description of the preferred embodiments taken in conjunction with the accompanying drawings.

DESCRIPTION OF THE PREFERRED EMBODIMENTS

Preferred embodiments of the present invention will now be described in detail with reference to the drawings.

Before describing a recording apparatus according to a first embodiment of the present invention, the general relationship between high-speed recording and an overlapped recording region will be described with reference to FIG. 1.

Figure 1:
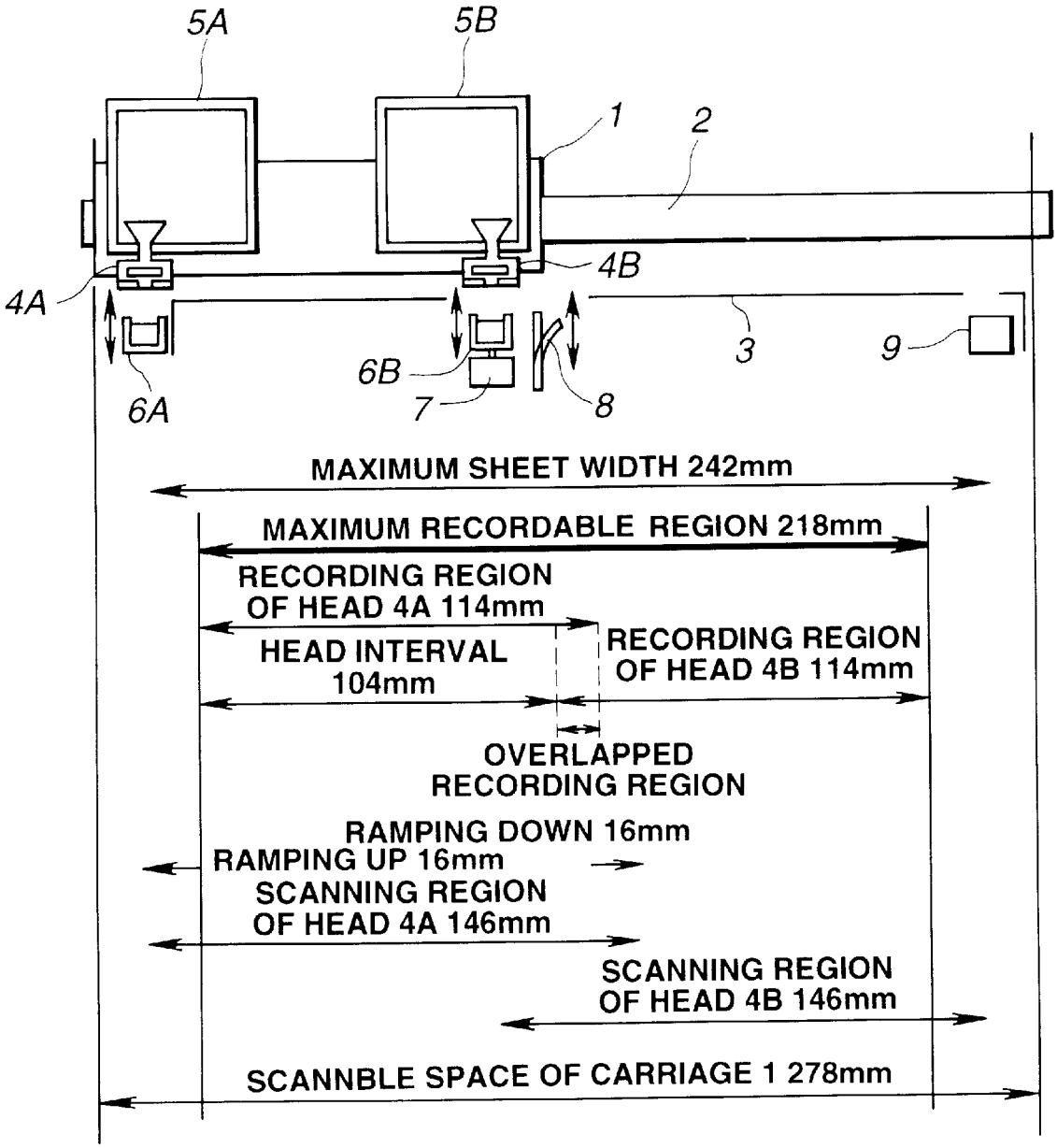
FIG. 1 is a diagram illustrating the relationship between divided recording and overlapped recording when using two recording heads.

In FIG. 1, two recording heads 4A and 4B are mounted on a carriage 1, which is slidably supported on a guide rail 2. Tanks 5A and 5B for supplying the heads 4A and 4B with ink, respectively, are also mounted on the carriage 1. When performing a recording operation on a maximum recordable region 218 mm long using the heads 4A and 4B, a moving distance for scanning is set to 114 mm which equals the width of a recording region by each of the heads 4A and 4B. As this region is relatively small, the recording speed by the movement of the carriage 1 is relatively high. The recording region by the head is determined by the interval between the heads 4A and 4B (hereinafter termed a "head interval" which indicates the distance between ink discharging ports of the respective heads).

A region scanned by both of the heads 4A and 4B in an overlapped state and capable of being recorded by the heads 4A and 4B (hereinafter termed an "overlapped recording region") has a value (10 mm) obtained by subtracting the head interval (104 mm) from the width of the recording region of each of the heads. In order to increase the recording speed, it is desirable to minimize the overlapped recording region.

In the present invention, the overlapped recording region is not dealt with only as a region connecting the divided recording regions, bit as a region where recording on an independent region having a predetermined size is performed by the cooperation of a plurality of heads. That is, divided recording by the recording heads 4A and 4B is performed by switching between a recording region having a relatively large size by divided recording and a recording region having a relatively small size by overlapped scanning, from the viewpoint of a size recordable by divided recording. In addition, various types of recording can be performed in accordance with the types of ink liquids used in recording for respective sizes. When intending to perform recording of a predetermined :size in an overlapped recording region, balance between the size and the degree of an increase in the recording speed is a problem.

First Embodiment

Figure 2:
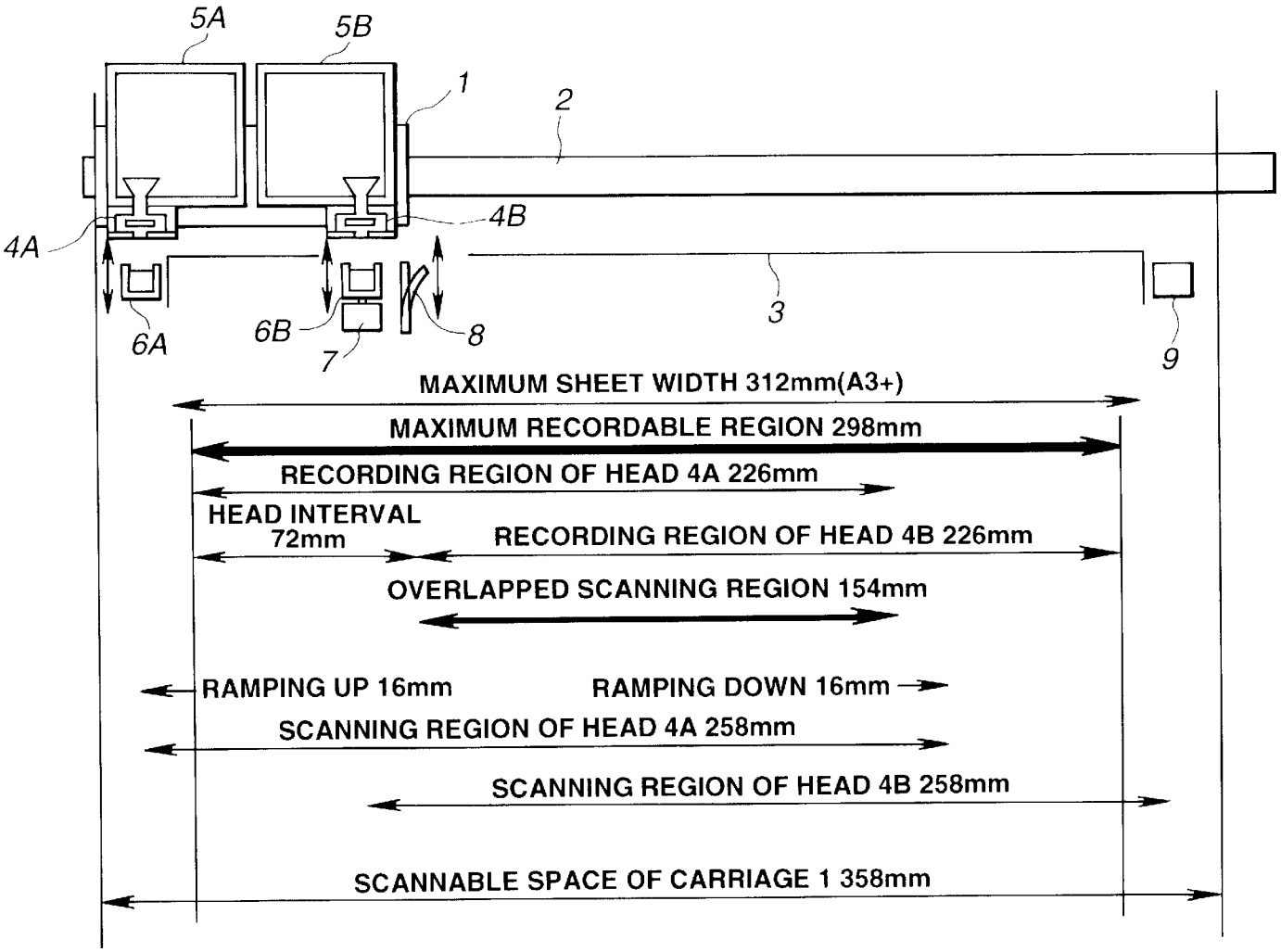
FIG. 2 is a diagram illustrating divided recording and overlapped recording when using two recording heads in an image recording apparatus according to a first embodiment of the present invention.

A first embodiment of the present invention is provided in consideration of the above-described viewpoint. FIG. 2 illustrates the principal configuration of the first embodiment.

In FIG. 2, ink-jet recording heads 4A and 4B are mounted on a carriage 1 with a head interval of 72 mm, and tanks 5A and 5B storing ink to be supplied to these heads 4A and 4B, respectively, are also mounted on the carriage 1. Each of the heads 4A and 4B and the tanks 5A and 5B can be detachably mounted on the carriage 1. As will be described later, according to the kind of ink to be used, it is also possible to integrally form a head and a corresponding tank, which can be detachably mounted on the carriage 1.

The carriage 1 is slidably supported on a guide rail 2, and is engaged with a driving mechanism (not shown), such as a belt or the like, for transmitting the driving force of a driving motor (not shown), so that the carriage 1 can perform scanning movement along the guide rail 2. As a result, the carriage 1 can move within a scannable space (358 mm) shown in FIG. 2. At that time, respective ink discharging ports of the heads 4A and 4B can be situated within respective scanning regions (258 mm) of the heads 4A and 4B. Except a ramping-up region and a ramping-down region, serving as acceleration/deceleration regions while the carriage 1 moves, the head 4A scans a left-side divided recording region (226 mm), serving as a divided scanning region, and the head 4B scans a right-side divided recording region (226 mm), serving as a divided scanning region.

Caps 6A and 6B are provided so as to correspond to the ink discharging ports of the heads 4A and 4B at portions within the scannable space of the carriage 1, respectively, under an extending platen 3. It is thereby possible to perform capping for the respective heads at respective home positions. A pump 7 for suctioning ink and the like via the cap 6B is connected to the cap 6B present within the recording region. By moving each of the heads 4A and 4B to a position facing the cap 6B at a predetermined timing and moving the cap 6B toward the head as the capping operation to contact the head, a sunction operation by the pump 7 can be performed in this state. A wiper 8 is provided at a position adjacent to the cap 6B. By protruding the wiper 8 in the scanning path of the corresponding head at a predetermined timing, the wiper 8 contacts the discharging port of the head to perform wiping.

A preliminary-discharge receptable 9 is provided at an end portion opposite to an end portion where the cap 6A is provided in the scannable space of the carriage 1. The head 4B can move to this position at a predetermined timing to perform a preliminary discharging operation. The head 4A can also perform a preliminary discharging operation by moving to a position facing the cap 6A. As described above, by providing a configuration for performing a suction recovery operation as well as a discharging operation within the recording region, and by providing preliminary-discharge receptacles at opposite end portions for the respective heads, it is possible to maximize a maximum recordable region relative to the scannable region of the carriage, i.e., to minimize the size of the apparatus relative to a certain maximum recordable region.

In the recording apparatus of the first embodiment discussed above, the head interval (72 mm), i.e., the distance between the discharging ports of the heads 4A and 4B, is set to substantially ¼ of the maximum recordable region (298 mm) realized by taking respective shares in recording on the scanning regions by the respective heads. The width of the overlapped scanning region is 154 mm. These sizes are set so that the maximum recordable region corresponds to the width of a relatively large A3-size (a format of 297 mm×420 mm) sheet (recording medium), and the overlapped scanning region corresponds to the width of an A5-size (a format of 148 mm×210 mm) sheet. That is, the width of the maximum recordable region is set to substantially twice the width of the overlapped scanning region.

In the first embodiment, when performing recording, for example, on an A3-size sheet corresponding to the maximum recordable region, recording is performed by taking respective shares in recording on the corresponding divided recording regions by the heads 4A and 4B by discharging the same kind of ink. On the other hand, when performing recording, for example, on an A5-size sheet corresponding to the overlapped recording region, recording is performed by the cooperation of the heads 4A and 4B using dark-color ink and light-color ink having different density values.

According to the recording apparatus of the first embodiment shown in FIG. 2, when performing recording on an A3-size sheet, since recording is performed by taking respective shares in recording on the maximum recordable region by the two heads, the recording speed can be higher than when performing recording using a single head. In addition, by maximizing the maximum recordable region relative to the scannable space of the carriage, the size of the recording apparatus can be reduced.

Figure 3A:
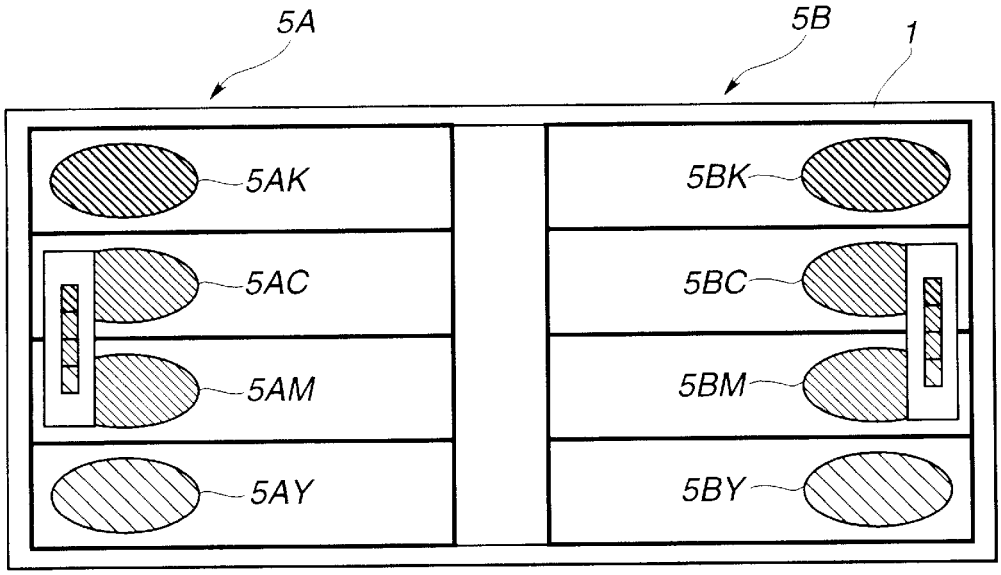
FIGS. 3(A) and 3(B) are schematic diagrams illustrating ink tanks used in divided recording and overlapped recording, respectively, in the first embodiment.
Figure 3B:
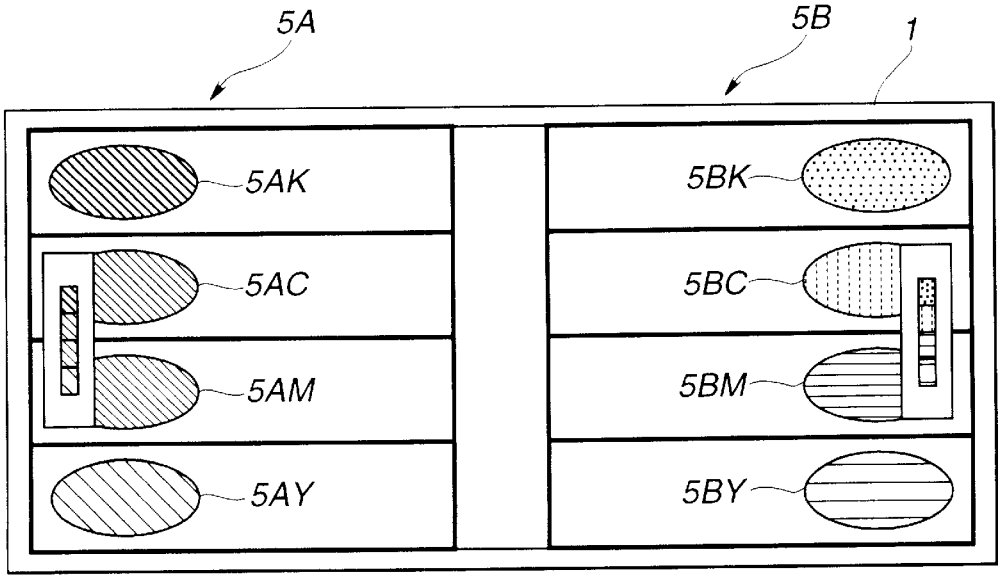

FIGS. 3(A) and 3(B) schematically illustrate the configurations of the ink tank 5A and 5B (the heads 4A and 4B) when performing recording on an A3-size sheet and on an A5-size sheet, respectively.

As shown in FIG. 3(A), when performing recording on an A3-size sheet by taking respective shares in recording on the region by the heads 4A and 4B, the heads 4A and 4B, each comprising heads for yellow (Y), magenta (M), cyan (C) and black (K), discharge ink having the same density value. Accordingly, ink tanks for each color of the ink tanks 5A (5AK, 5AC, 5AM and 5AY) and 5B (5BK, 5BC, 5BM and 5BY) store ink having the same density value. When performing recording on the maximum recordable region, such as an A3-size sheet or the like, various kinds of shares in recording by the heads 4A and 4B in the overlapped recording region can be considered. In the first embodiment, respective shares in recording by the heads 4A and 4B are determined so that the number of discharging ports from among a plurality of discharging ports decreases and increases in the scanning direction for one and the other of the recording heads 4A and 4B, and the total number of discharging ports of the heads 4A and 4B equals the total number of discharging ports of one head.

On the other hand, as shown in FIG. 3(B), when performing recording, for example, on an A5-size sheet in the overlapped recording region, the head 4A discharges dark-color ink as in the above-described case, and the head 4B discharges light-color ink. Accordingly, the tank for each color of the ink tank 5A (5AK, 5AC, 5AM and 5AY) stores ordinary dark-color ink, and the tank for each color of the ink tank 5B (5BK, 5BC, 5BM and 5BY) stores light-color ink.

Figure 4A:
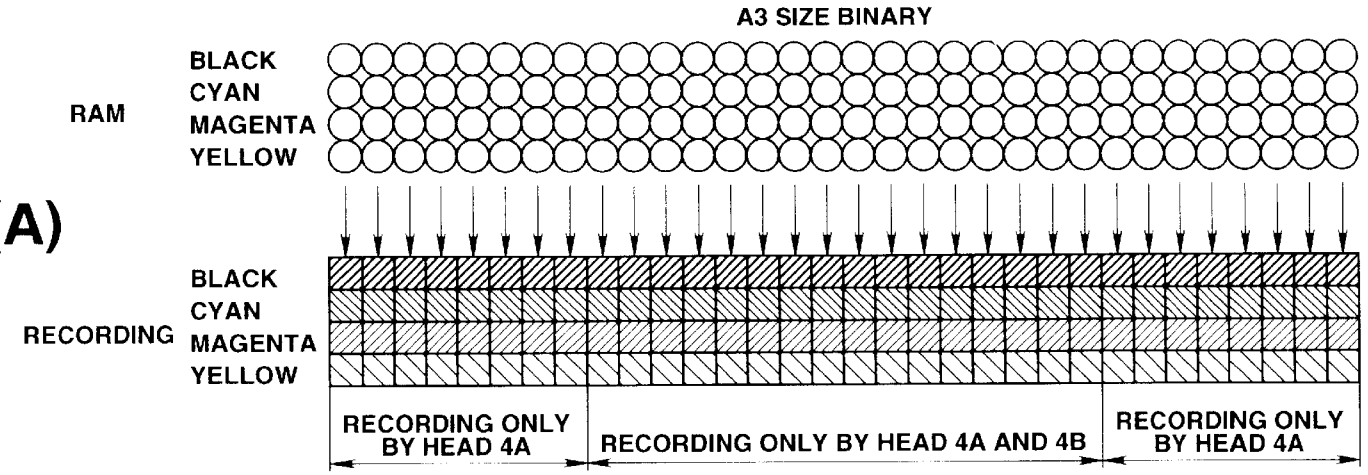
FIGS. 4(A) and 4(B) are schematic diagrams illustrating a RAM (random access memory) for storing driving data, and results of recording of respective pixels in divided recording and overlapped recording, respectively, in the first embodiment.
Figure 4B:
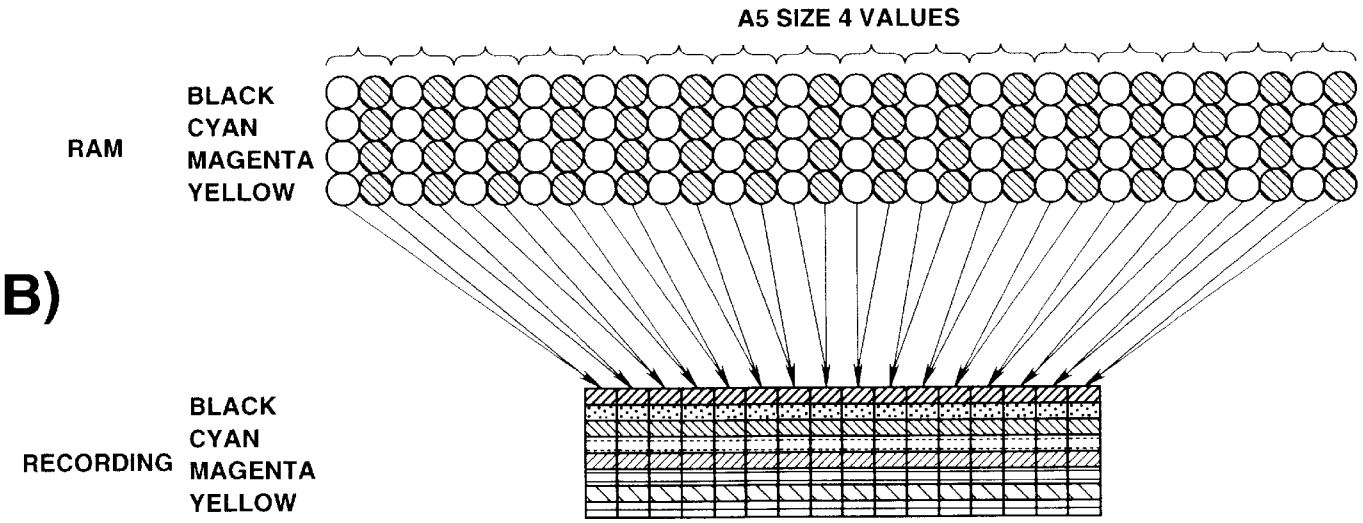

FIGS. 4(A) and 4(B) are schematic diagrams illustrating head driving data and results of recording based on the data when performing recording on an A3-size sheet and an A5-size sheet, respectively.

When performing recording on an A3-size sheet, binary recording is performed by discharging or not discharging ink having the same density value from recording heads for each color of the recording heads 4A and 4B in the above-described manner. FIG. 4(A) illustrates driving data stored in a RAM, and a result of ink discharge for respective pixels based on the driving data. A black circle for each of ink liquids K, C, M and Y illustrated in the RAM represents one bit, which indicates that data to be discharged equals "1". Data "0" can be represented by a white circle. The 1-bit data in the RAM corresponds to data of one pixel in recording. In the case shown in FIG. 4(A), since all data stored in the RAM assume "1", the result of recording by such data is entirely black recording obtained by discharging ink for all pixels, as shown in FIG. 4(A).

As described above, when performing recording on an A3-size sheet, for an image for one line shown in FIG. 4(A), a predetermined number of pixels at the left side are recorded only by the head 4A, and a predetermined number of pixels at the right side are recorded only by the head 4B. Recording on a portion corresponding to the overlapped recording region by the respective heads is shared by the heads 4A and 4B according to the above-described predetermined sharing rule.

On the other hand, when performing recording on an A5-size sheet in the overlapped recording region shown in FIG. 4(B), 4-value recording is performed by the cooperation of the heads 4A and 4B. That is, the driving data comprises data representing "no discharge", "discharge of light-color ink", "discharge of dark-color ink" and "discharge of light-color ink and dark-color ink" (in FIG. 4(B), only data of "discharge of light-color ink and dark-color ink" is shown), and these data are stored in the RAM. Accordingly, driving data for one pixel is represented by two bits. In the case shown in FIG. 4(B), two bits for each pixel stored in the RAM represent data when recording a pixel having a maximum density value, i.e., data when discharging both of light-color ink and dark-color ink. When performing recording on an A5-size sheet, data of one bit and data of the other bit of two-bit data corresponding to each pixel stored in the RAM shown in FIG. 4(B) are allocated to respective head drivers as driving data for the head 4A and driving data for the head 4B.

As is apparent from the foregoing description with reference to FIGS. 4(A) and 4(B), according to the first embodiment, the amount of storage in the RAM for driving data for one line has the same value when performing recording on an A3-size sheet by taking respective shares in recording on the maximum recordable region by the two heads, and when performing recording on an A5-size sheet by the cooperation of the two heads on the overlapped recording region. Hence, it is possible to completely use a single RAM and to effectively utilize a memory in the apparatus. That is, since binary recording is performed for an A3-size sheet, a memory capacity of one bit for each pixel suffices. On the other hand, since 4-value recording is performed for an A5-size sheet, two bits are required for each pixel. However, since the width of one line recorded by two heads in A5-size recording is ½ of the width in A3-size recording, the number of bits used in the RAM has the same value for the two types of recording.

The effective utilization of the RAM as described above is not limited to the case of using two recording heads as in the first embodiment. For example, when using three recording heads for each color which discharge dark-color, medium-color and light-color ink liquids, and performing recording on the overlapped region by four values, i.e., "no discharge", "discharge of light-color ink", "discharge of medium-density-color ink" and "discharge of dark-color ink" and when performing recording by divided scanning using two recording heads discharging clark-color ink, the same effects can also be obtained by making the ratio of the widths of the respective regions to be 2:1 as in the above-described case.

It is also apparent from the foregoing description that the same effects can also be obtained when the ratio of the widths of the respective regions and the ratio of gradation values of recording in the respective regions are the same.

Although in the first embodiment, recording on the overlapped recording region is performed by the cooperation of the heads using ink liquids having different density values, the present invention is not limited to such an approach. For example, by performing recording on the overlapped region by cooperation of the heads using ink having the same density value, i.e., by forming one dot by one ink droplet or a plurality of ink droplets, a gradation image can be obtained. Furthermore, by always forming one dot by a plurality of ink droplets, emphasized recording can be performed.

Figure 5:
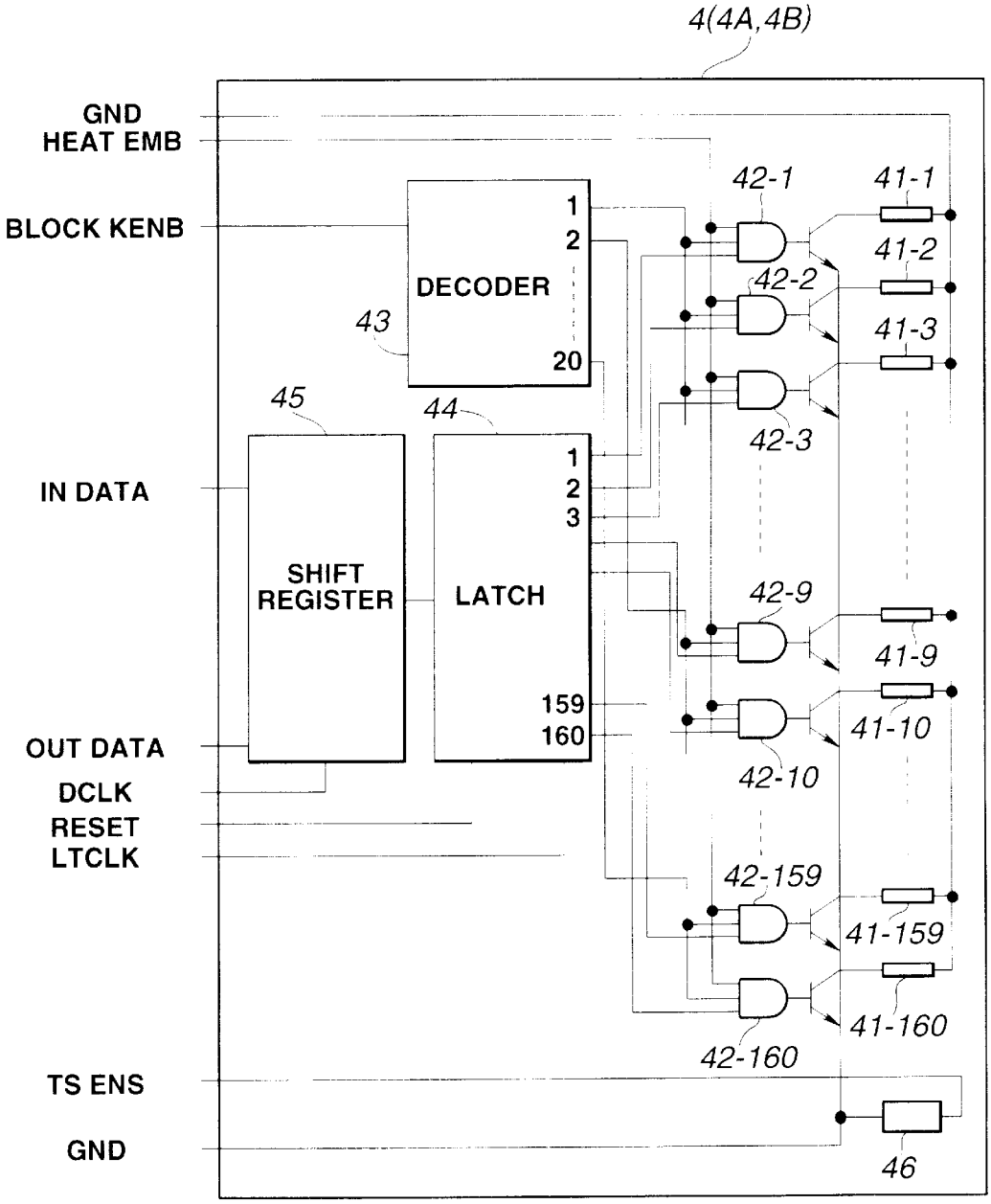
FIG. 5 is a circuit diagram illustrating a driving circuit for a recording head which can be used in the first embodiment.

FIG. 5 is a block diagram illustrating circuitry for driving heating elements of the recording head 4 (4A, 4B). Heating elements 41-1–41-L60 are provided so as to correspond to all ink discharging ports, and can be independently heated. The 160 heating elements comprise 24 elements for each of Y (yellow), M (magenta) and C (cyan), 64 elements for K (black), and 8 elements for each interval between the respective ink colors. If all of the heating elements 41 are simultaneously driven, a large current flows at one time, thereby increasing the load of the power supply. In addition, energy supplied to each of the heating elements decreases due to a voltage drop caused by an interconnection resistance and the like, there is the possibility that normal recording cannot be performed. As a result, degradation in the image quality may arise. Accordingly, the recording head 4 of the first embodiment is disposed in a slightly inclined state, and known time-division driving is performed in which ink is discharged by adjusting image data and a recording timing for each block comprising a predetermined number of heating elements.

Various time-division driving methods have been proposed and practically used, and any of these methods may be adopted. In the first embodiment, 160 discharging ports are divided into 20 blocks each comprising 8 discharging ports, including 8 discharging ports as intervals between respective colors, and ink liquids are sequentially discharged from these blocks. Ink liquids are discharged by inclining the recording head 4 in accordance with the scanning speed of the recording head 4 in order to prevent oblique recording of a straight line due to a time difference between discharging operations.

Ink within the discharging port rapidly heated by the heat of the heating element 41 forms a bubble due to film boiling. An ink droplet is discharged toward a recording medium P by the pressure caused by the generation of the bubble to form characters or images on the recording medium P. At that time, the volume of the discharged ink droplet of each color is about 40 ng. An ink liquid channel including the heating element 41 and communicating with the discharging port is provided for each discharging port, and a common liquid chamber for supplying the liquid channels with ink is provided behind the liquid channels for each color.

Ink is supplied from the common liquid chamber to the ink tank 5 (5A, 5B) for each color via an ink supply path. The heating element 41, comprising an electrothermal transducer for generating thermal energy utilized for discharging ink droplets, and an electrode interconnection for supplying the heating element 41 with electric power are provided at the ink channel corresponding to each discharging port. The heating elements 41 and the electrode interconnections are formed on a substrate, comprising silicon or the like, according to a film forming technique. A protective film is formed on the heating element 41 in order to prevent direct contact between ink and the heating elements 41. By further laminating partitions comprising a resin, a glass material or the like, on the substrate, the discharging ports, the ink liquid channels, the common liquid chamber and the like are formed. Such a recording method using the heating elements 41 comprising electrothermal transducers is usually called a bubble-jet recording method because a bubble formed by applying thermal energy is used when discharging an ink droplet.

In FIG. 5, each of AND gates 42-1–42-160 obtains a logic product of a selection signal for time division output from a decoder 43, driving data output from a latch circuit 44, and a heat enable signal defining a driving time period, and outputs a driving signal to the corresponding heating element 41. A shift register 45 converts input image data into parallel data and outputs the obtained signal to the latch circuit 44.

In the first embodiment, a temperature sensor 46 is provided at the recording head 4 as a mechanism for monitoring the recording heads 4A and 4B. The provision of the temperature sensor 46 stabilizes the recording characteristics by determining optimum driving conditions for the recording head in accordance with the temperature of the recording heads 4A and 4B, and by operating a maintenance mechanism based on temperature information.

Figure 6:
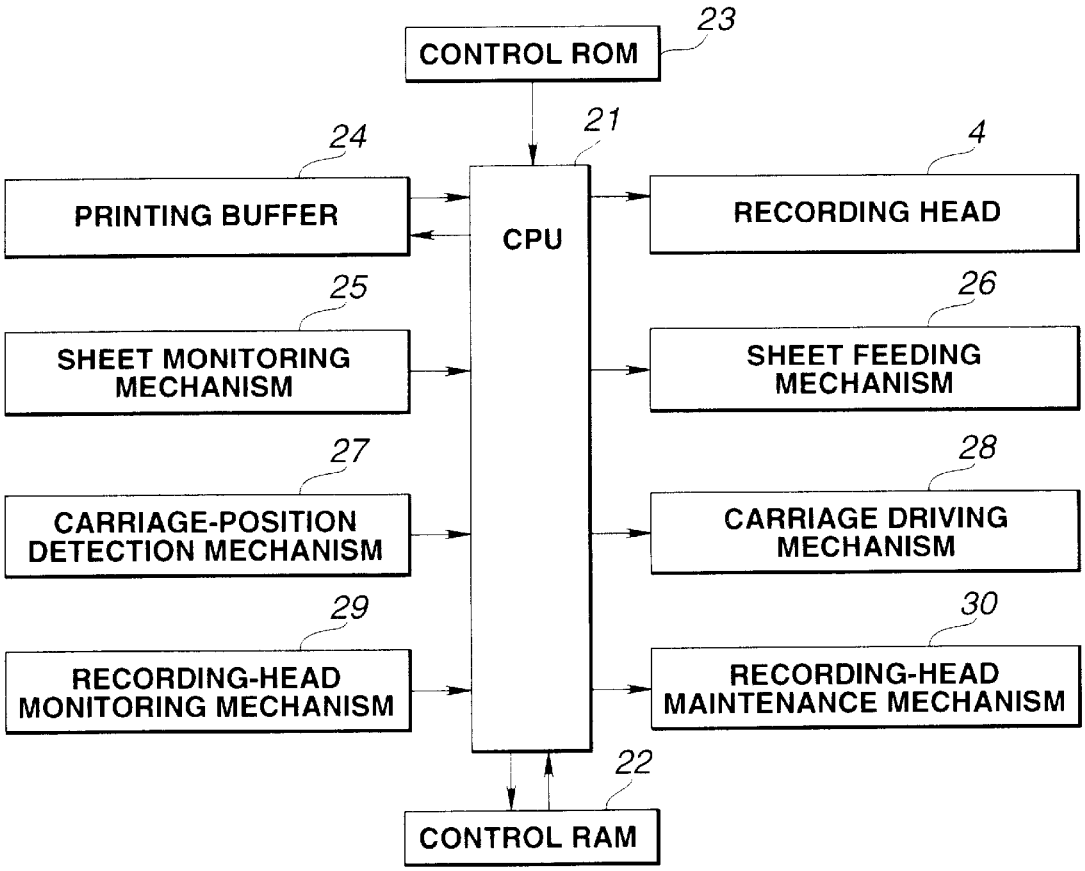
FIG. 6 is a block diagram illustrating the configuration of control for the image recording apparatus of the first embodiment.

FIG. 6 is a block diagram illustrating an ink-jet recording apparatus to which the present invention can be applied. Data of characters and images to be recorded (hereinafter termed "image data") is input from a host computer to a receiving buffer of the recording apparatus. Data for confirming if the data is correctly transferred and data indicating the operating state of the recording apparatus are transmitted from the recording apparatus to the host computer. The data stored in the receiving buffer is controlled by a CPU 21, a control RAM 22 and a control ROM 23, and is temporarily stored in a printing buffer (RAM) 24, and is then sent to the recording heads 4A and 4B as recording data. That is, the printing buffer 24 comprises the RAM for driving shown in FIG. 4. A sheet feeding mechanism 26 drives a sheet feeding roller and a line feeding roller according to an instruction from the CPU 21 based on information from a sheet monitoring mechanism 25, by controlling a driving source, such as a motor or the like. A carriage driving mechanism 28 controls the drive by the carriage 1 by controlling a carriage driving source according to an instruction from the CPU 21 based on information from a carriage-position detection mechanism 27. A recording-head maintenance mechanism 30 can optimize the maintenance and driving conditions of the head 4 according to an instruction from the CPU 21 based on information from a recording-head monitoring mechanism 29, comprising a sensor for detecting the temperature of the recording head, a sensor for detecting the presence of a sheet, and the like.

Second Embodiment

Figure 7:
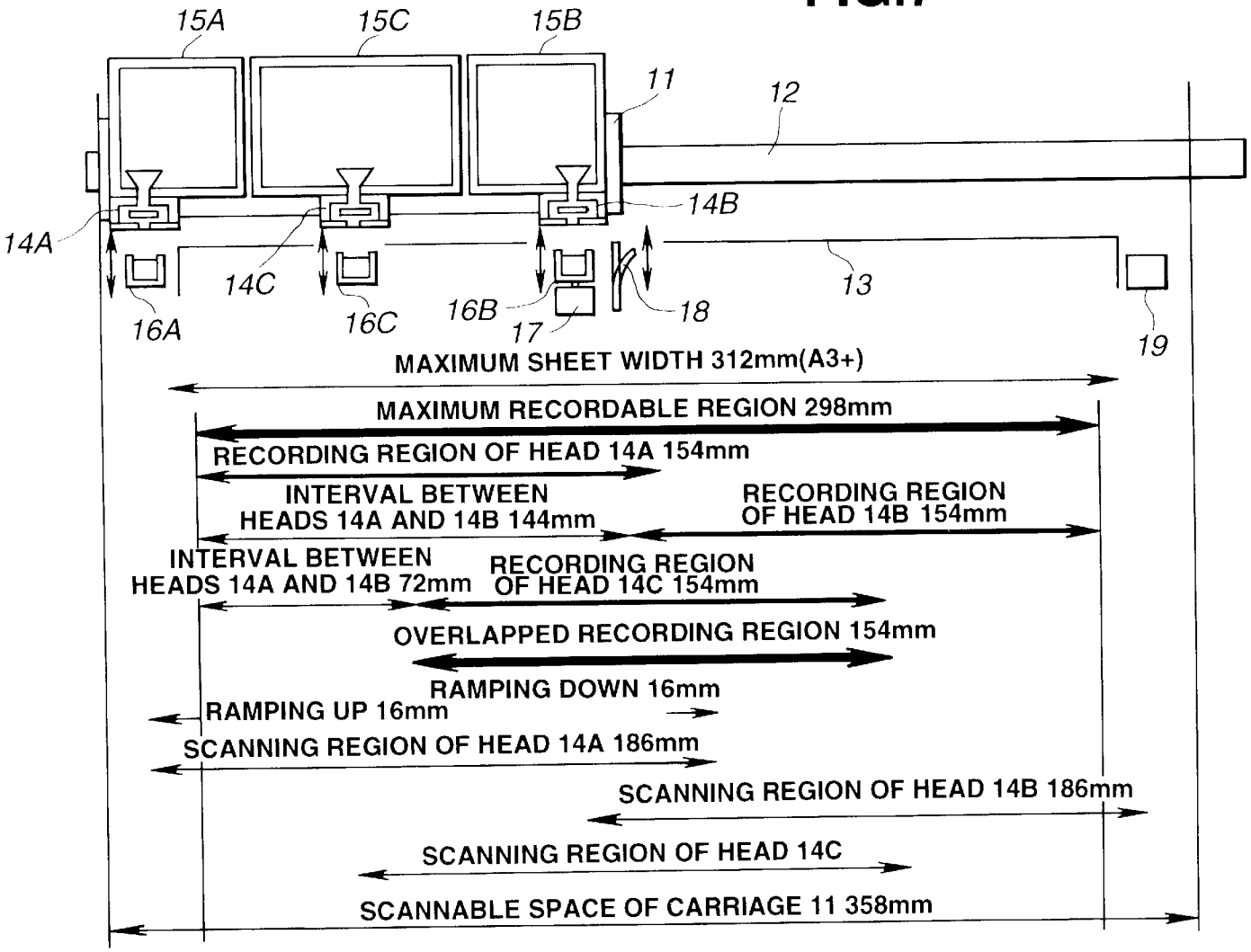
FIG. 7 is a diagram illustrating divided recording and overlapped recording when using three recording heads in an image recording apparatus according to a second embodiment of the present invention.

FIG. 7 is a diagram illustrating the schematic configuration of a recording apparatus according to a second embodiment of the present invention, an overlapped recording region by respective recording heads, and the like. In FIG. 7, components corresponding to those shown in FIG. 1 are indicated by the same reference numerals, and a description thereof will be omitted.

In the recording apparatus of the second embodiment, the maximum size of a recording medium which can be recorded by the recording apparatus is set to the A3 size. Accordingly, the maximum sheet width is set to 312 mm. In order to realize recording on an A3-size sheet, it is necessary for the recording heads to scan within the maximum recordable region (298 mm) obtained by subtracting a ramping-up region and a ramping-down region (16 mm each), serving as acceleration/deceleration regions, from the above-described scanning region.

In order to minimize the size of the entire apparatus while maintaining the maximum recordable region, a scannable space of a carriage 11 is determined to be 358 mm.

In accordance with the above-described restriction relating to the size of a recording medium, such as recording paper or the like, and the provision of a small-size apparatus, the recording apparatus of the second embodiment has the following configuration.

In FIG. 7, ink-jet recording heads 14A, 14B and 14C are mounted on the carriage 11 at an interval of 72 mm, and tanks 15A, 15B and 15C storing ink liquids to be supplied to the heads 14A, 14B and 14C, respectively, are also mounted on the carriage 11. Dark-color ink liquids for respective ink colors are stored in the tanks 15A and 15B, light-color ink liquids for respective colors are stored in the tank 15C. Accordingly, the heads 14A and 14B discharge dark-color ink, and the head 14C discharges light-color ink. Each of these heads and tanks can be detachably mounted on the carriage 11 independently. As will be described later, according to the kind of used ink, a head and a corresponding tank may be integrally formed, so that the combination of the head and the tank can be detachably mounted on the carriage 11.

The carriage 11 can move within the scannable space (358 mm) shown in FIG. 7. At that time, respective ink discharging ports of the heads 14A, 14B and 14C can be situated within respective scanning regions (186 mm). Except a ramping-up region and a ramping-down region, serving as acceleration/deceleration regions while the carriage 1 moves, the head 14A scans a left-side divided recording region (154 mm), serving as a divided scanning region, the head 14B scans a right-side divided recording region (154 mm), serving as a divided scanning region, and the head 14C scans a central-portion divided recording region (154 mm), serving as a divided scanning region.

Caps 16B and 16C are provided so as to correspond to the ink discharging ports of the heads 14B and 14C at portions within the scannable space of the carriage 11 under an extending platen 13. A cap 16A is provided so as to correspond to the ink discharging port of the head 14A at a left end portion of the apparatus outside the platen 13. It is thereby possible to perform capping for each of the heads present at a home position. A pump 17 for suctioning ink and the like via the cap 16B is connected to the cap 16B present within the overlapped recording region by the three heads. By moving each of the heads 14A, 14B and 14C to a position facing the cap 16B at a predetermined timing and moving the cap 16B toward the head as the capping operation, to contact the head, a sunction operation by the pump 17 can be performed in this state.

As described above, in the second embodiment, also, by providing a configuration for performing a suction recovery operation as well as a discharging operation within the recording region, and by providing preliminary-discharge receptacles at opposite end portions outside the platen 13, it is possible to minimize the size of the apparatus relative to a certain maximum recordable region.

In the recording apparatus of the second embodiment shown above, the head interval (72 mm), i.e., the distance between the discharging ports of the respective pairs of the heads 14A, 14B and 14C, is set to be substantially ¼ of the maximum recordable region (298 mm) realized by taking respective shares in recording on the divided recording region. Hence, the width of the overlapped recording region by the recording heads 14A, 14B and 14C is 154 mm. These sizes are set so that the maximum recordable region corresponds to the width of a relatively large A3-size (a format of 297 mm×420 mm) sheet (recording medium), and the overlapped recording region corresponds to the width of an A5-size (a format of 148 mm×210 mm). That is, the width of the maximum recordable region is set to be substantially twice the width of the overlapped recording region.

In the second embodiment, when performing recording, for example, on an A3-size sheet corresponding to the maximum recordable region, recording is performed taking respective shares in recording on corresponding divided recording regions by the heads 14A and 14B by discharging the same kind of ink. On the other hand, when performing recording, for example, on an A5-size sheet corresponding to the overlapped recording region, recording is performed by discharging ink having a density value different from that of the heads 14A and 14B, light-color ink in this case, from the head 14C, to perform gradation recording by the cooperation of the two kinds of ink.

According to the recording apparatus of the second embodiment shown in FIG. 7, when performing recording on an A3-size sheet, by dividing the scanning region by the two heads, the recording speed can be higher than when performing recording using a single head. In addition, by maximizing the maximum recordable region relative to the scannable space of the carriage, the size of the recording apparatus can be reduced.

Preliminary discharging and suction recovery processing performed as discharge recovery processing for each of the recording heads in the second embodiment is performed in the following manner.

Preliminary discharging performed at a predetermined timing during recording is performed by moving only the heads 14A and 14B to the positions of the cap 16A and the prelimary-discharge receptacle 19, respectively. Preliminary discharge is not performed for the head 14C, because the cap 16C onto which the head 14C is to discharge ink as preliminary discharging during recording is covered by a recording sheet and, in addition, the head 14C cannot move to the position of the cap 16A or the preliminary-discharge receptacle 19. When a recording sheet does not cover the cap 16C, for example, when recording is performed on an A5-size sheet in the overlapped recording region, or when a recording operation is not performed, the head 14C can perform preliminary discharging onto the cap 16C.

In the second embodiment, in accordance with the above-described configuration of preliminary discharging, the head discharging light-color ink is arranged at the center and the heads discharging dark-color ink are arranged at two sides thereof on the carriage 11. This is because a necessity for preliminary discharging is greater for ink having a higher concentration of a color material, such as a dye or the like, whose viscosity tends to increase. Accordingly, during a recording operation using a large-size sheet covering the cap 16C, such as an A3-size sheet or the like, in the conveying process, preliminary discharging is not performed for the head 14C discharging light-color ink. This is because the degree of an increase in the viscosity of ink having a low concentraion of a color material, such as a dye or the like, is small and :no problem will arise even if preliminary discharging is not performed for a certain time period for a head discharging light-color ink.

The dark-color ink discharged by the heads 14A and 14B present at the two sides has the density of ink which is usually used, and binary recording on an A3-size sheet or the like can be performed in a region obtained by combining the divided recording regions of the heads 14A and 14B. Although various recording methods can be considered for a portion where the divided recording regions of the two heads overlap in this recording (10 mm, not shown), the method used in the first embodiment is adopted in the second embodiment.

In recording on an A5-size sheet or the like in the overlapped recording region, a high gradation image is recorded using the heads 14A and 14B having dark-color ink and the head 14C having light-color ink. As is apparent from FIG. 7, in this recording on the overlapped recording region, the left side from the center of the region is recorded by the heads 14A and 14C, and the right side is recorded by the heads 14B and 14C. Accordingly, during this overlapped recording, when, for example, performing recording by scanning the region toward the right in FIG. 7, since discharging operations are performed in the sequence of the heads 14C and 14A at the left side and in the sequence of the heads 14B and 14C in the right side, unevenness in hue may occur between the right side and the left side. In the second embodiment, this problem can be solved by peforming bidirectional recording. Alternatively, by performing recording by the dark-color-ink heads 14A and 14B and recording by the light-color-ink head 14C according to different scanning operations, the above-described discharging sequence can be invariable. Furthermore, by providing different positions in the sheet feeding direction for the dark-color-ink heads 14A and 14B and for the light-color-ink head 14C, recording can also be performed by different scanning operations.

Figure 8A:
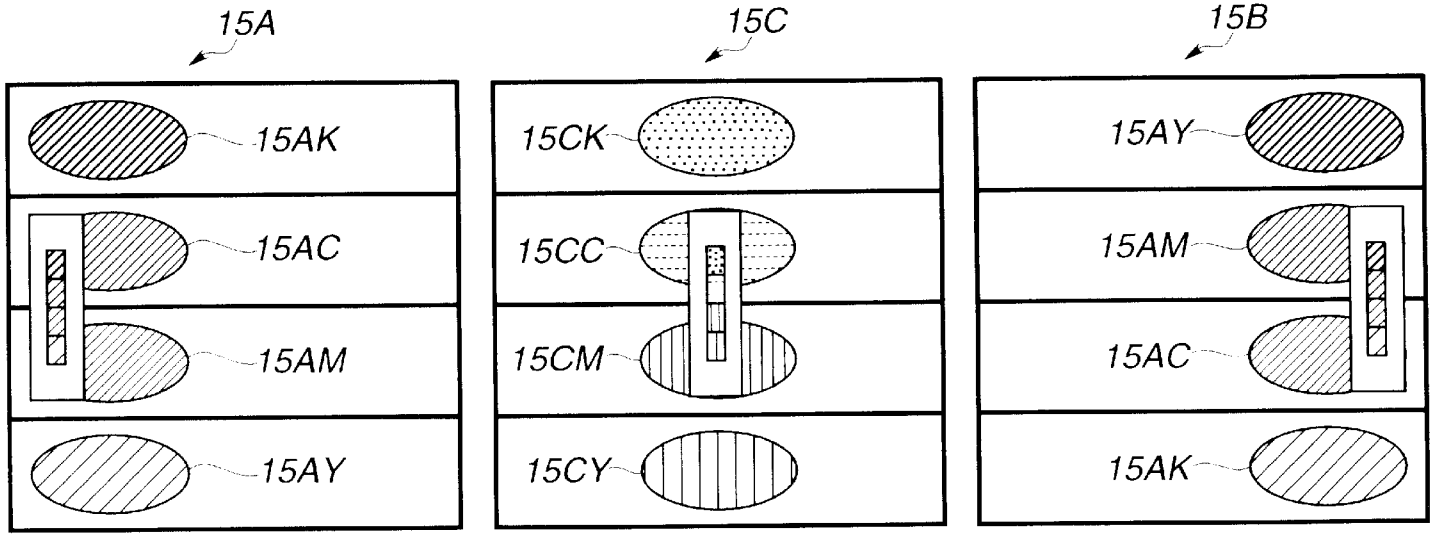
FIGS. 8(A) and 8(B) are schematic diagrams illustrating ink tanks which can be used in the second embodiment.
Figure 8B:
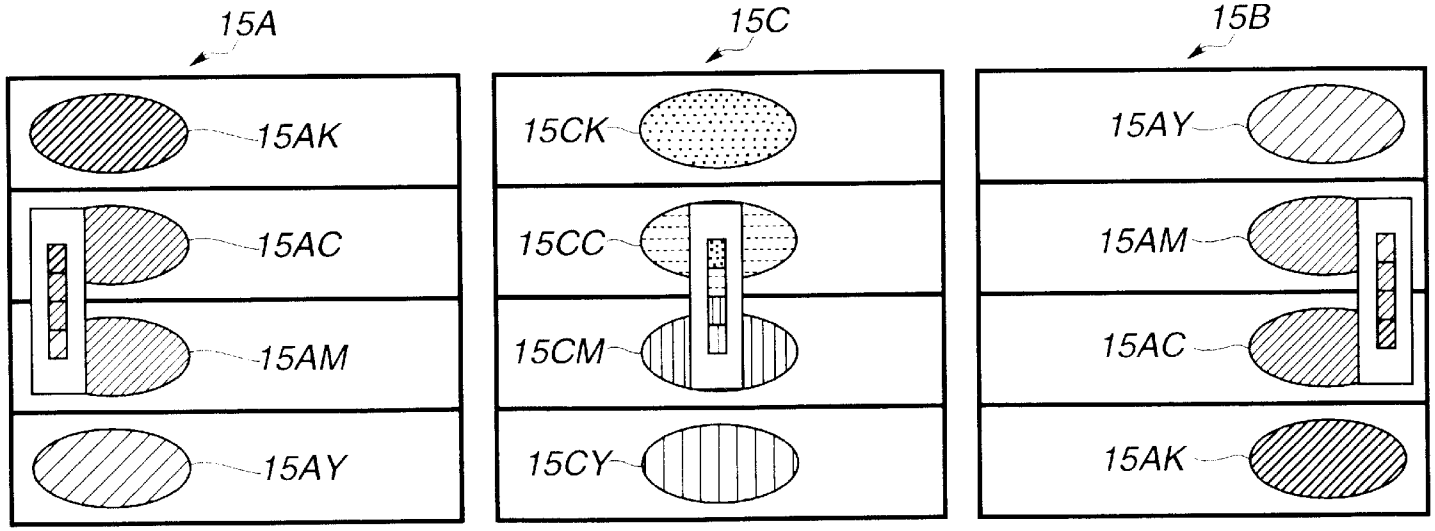

FIGS. 8(A) and 8(B) are schematic diagrams illustrating the configurations of ink tanks which can be used in the second embodiment.

In the configuration shown in FIG. 8(A), the same arrangement order is provided for tanks of respective colors of each of the ink tanks 15A and 15B at the two sides. That is, for the ink tanks 15A and 15B at the two sides, ink tanks 15AK and 15BK, 15AC and 15BC, 15AM and 15BM, 15AY and 15BY, respectively, are arranged in the order of black (K), cyan (C), magenta (M) and yellow (Y) from above in FIG. 8(A). Accordingly, for example, by connecting tanks of the same color at the two sides, a large-capacity tank can be provided. This configuration is particularly effective because, when arranging the positions of the dark-color-ink heads and the position of the light-color-ink head in a state of being shifted in the sheet feeding direction as described above, the configuration of arranging the tanks 15A and 15B, and the tank 15C in the lateral direction in FIG. 8(A) can be avoided. In addition, since the same recording position can be provided for the left and right heads for each ink at each scanning operation, color matching in the region shared by the left and right heads can be easily performed.

In the configuration shown in FIG. 8(B), as is apparent from FIG. 8(B), the order of arrangement of tanks for respective ink colors is reversed between the ink tanks 15A and 15B provided at the two sides. According to this configuration, it is possible to provide the same shape for the tanks 15A and 15B from the viewpoint of connection of the recording heads, and to provide only one kind of tank for dark-color ink.

Since the configurations of a driving circuit for the recording head and control of the recording apparatus are basically the same as in the first embodiment, a description thereof will be omitted.

Although in the foregoing embodiments, the numbers of the discharging ports of each recording head are 24 for Y, M and C, and 64 for K, the number of discharging ports for each color may be equal, for example, 24 or 32.

The individual components shown in outline or designated by blocks in the drawings are all well-known in the shuttle-type gradation recording apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for performing recording of an image on a recording medium using a plurality of recording heads disposed at a predetermined interval in a scanning direction, said apparatus comprising:

scanning means for scanning a plurality of recording heads relative to corresponding divided recording regions of an entire recording region of a recording medium, the entire recording region being divided into the divided recording regions in a scanning direction, each of the divided recording regions including an overlapped recording region of the entire recording region; and recording control means for controlling the plurality of recording heads to perform one of recording in a first recording mode and a second recording mode when said scanning means scans the plurality of recording heads relative to the corresponding divided recording regions, wherein in the first recording mode the recording control means controls at least two of the plurality of recording heads to perform shared recording of respective portions of an image on respective divided recording regions, and wherein in the second recording mode the recording control means controls at least two of the plurality of recording heads to perform overlapped recording of at least a portion of an image on the overlapped recording region.

2. An apparatus according to claim 1, wherein an image recorded in the first recording mode and an image recorded in the second mode have different levels of recording quality.

3. An apparatus according to claim 2, wherein said recording control means controls the plurality of recording heads to record with different levels of recording quality by recording different number of gradation levels for recording in the first recording mode and for recording in the second recording mode.

4. An apparatus according to claim 3, wherein a density of a recording material used by each of the recording heads differs between the first recording mode and the second recording mode, and wherein said recording control means controls the plurality of recording heads to record the different numbers of gradation levels by causing a combination of recording heads to record using recording materials of different densities in the first recording mode and in the second recording mode.

5. An apparatus according to claim 4, wherein the recording material comprises ink, and wherein each of the plurality of recording heads performs recording by discharging the ink.

6. An apparatus according to claim 5, wherein each of the plurality of recording heads generates a bubble in the ink utilizing thermal energy and discharges the ink by a pressure of the bubble.

7. An apparatus according to claim 3, wherein said recording control means controls the plurality of recording heads to make the number of gradation levels to be 2 in the first recording mode, and the number of gradation levels to be 4 in the second recording mode.

8. An apparatus according to claim 1, wherein a size of an image in the scanning direction recorded on the divided recording regions by the at least two recording heads in the first recording mode is larger than a size of an image in the scanning direction recorded on the overlapped recoreding region by the at least two recording heads in the second recording mode.

9. An apparatus according to claim 8, wherein a maximum size of the image in the scanning direction recorded by the at least two recording heads in the first recording mode is substantially twice the size of the image in the scanning direction recorded by the at least two recording heads in the second recording mode.

10. An apparatus according to claim 9, wherein the size of the image recorded in the first recording mode corresponds to an A3 sheet size, and wherein the size of the image recorded in the second recording mode corresponds to an A5 sheet size.

11. An apparatus according to claim 1, wherein said scanning means comprises a carriage movable in the scanning direction, and wherein the plurality of recording heads are detachably provided to said carriage.

12. An apparatus according to claim 11, wherein the plurality of recording heads are mounted at a predetermined interval on said carriage, and the predetermined interval corresponds to a size of respective divided recording regions, and a maximum size of an image recorded in the scanning direction on the divided recording regions by the at least two recording heads in the first recording mode is substantially twice a size of an image recorded in the scanning direction on the overlapped recording region by the at least two recording heads in the second recording mode.

13. An apparatus according to claim 1, wherein a maximum size of an image in the scanning direction recorded by the plurality of recording heads in the first recording mode is substantially twice a size of an image in the scanning direction recorded on the overlapped recording region by the plurality of recording heads in the second recording mode, and wherein a number of gradation levels equals 2 for recording in the first recording mode, and a number of gradation levels equals 4 for recording in the second recording mode, and further comprising memory means for storing an equal amount of driving data in the first recording mode and in the second recording mode.

14. An apparatus according to claim 1, wherein each of the recording heads records a plurality of colors on the recording medium.

15. A recording method for performing recording on a recording medium using a plurality of recording heads disposed at a predetermined interval in a scanning direction, said method comprising the steps of:

scanning a plurality of recording heads relative to corresponding divided recording regions of an entire recording region of a recording medium, wherein the entire recording region is divided into the divided recording regions in the scanning direction, each of the divided recording regions including an overlapped recording region of the entire recording region; and controlling the plurality of recording heads to perform one of recording in a first recording mode and a second recording mode during said scanning step, wherein in the first recording mode at least two of the plurality of recording heads are controlled to perform shared recording of respective portions of an image on respective divided recording regions, and wherein in the second recording mode at least two of the plurality of recording heads are controlled to perform overlapped recording of at least a portion of an image on the overlapped recording region.

16. A recording apparatus for performing recording on a recording medium using a plurality of recording heads for discharging ink liquids having different density values, said apparatus comprising:

a carriage for mounting a plurality of recording heads having ink discharge parts, wherein a first recording head discharges ink having a first density and is disposed near an end portion of aid carriage;

scanning means for causing the plurality of recording heads to scan corresponding divided recording regions of an entire recording region of a recording medium, wherein the entire recording region is divided into the divided recording regions in a scanning direction, each of the divided recording regions including an overlapped recording region of the entire recording region; and recording control means for controlling the plurality of recording heads to perform one of recording in a first recording mode and a second recording mode when said scanning means scans the plurality of recording heads relative to the corresponding divided recording regions, wherein in the first recording mode the recording control means controls at least two of the plurality of recording heads to perform shared recording of respective portions of an image on respective divided recording regions, and wherein in the second recording mode the recording control means controls at least two of the plurality of recording heads to perform overlapped recording of at least a portion of an image on the overlapped recording region.

17. An apparatus according to claim 16, further comprising one or more ink discharge receptacles corresponding to one or more recording heads, said ink discharge receptacles being disposed outside the entire recording region.

18. An apparatus according to claim 17, wherein said ink discharge receptables are provided adjacent to, and outside, opposing sides of the entire recording region.

19. An apparatus according to claim 18, wherein one of said ink discharge receptacles is operable with capping means for capping a recording head disposed at an end portion of said carriage.

20. An apparatus according to claim 17, wherein at least one of said ink discharge receptacles is operable with capping means and corresponds to a recording head disposed at a position between opposing end portions of sid carriage and in a region through which a recording head is scanned.

21. An apparatus according to claim 16, further comprising suction means for sucking an ink during a suction operation, said suction means provided in a region through which the plurality of recording heads are scanned.

22. An apparatus according to claim 21, wherein said suction means is provided so as to be movable into and out of a feeding path of the recording medium.

23. An apparatus according to claim 21, wherein said suction means includes a cap for capping a recording head, said suction means also comprising an ink discharge receptable for holding ink discharged from a recording head disposed at an end portion of said carriage.

24. An apparatus according to claim 16, further comprising wiping means for wiping surfaces of the ink discharging ports of the plurality of recording heads, said wiping means provided in a region through which the plurality of recording heads are scanned.

25. An apparatus according to claim 24, wherein said wiping means is provided so as to be movable into and out of a feeding path of the recording medium.

26. An apparatus accoding to claim 16, wherein the plurality of recording heads discharge liquid inks of a plurality of colors onto the recording medium.

* * * * *

UNITED STATES PATENT AND TRADEMARK OFFICE

CERTIFICATE OF CORRECTION

PATENT NO. : 6,095,637
DATED : August 1, 2000
INVENTOR(S) : Hiromitsu Hirabayashi et al.

It is certified that error appears in the above-identified patent and that said Letters Patent is hereby corrected as shown below:

Column 2,
Line 41, change "performing" to -- perform --.

Column 4,
Line 30, change "large- : size" to --large-size --; and
Line 57, change "recovering" to -- recovery --.

Column 5,
Line 59, change "bit" to -- but --.

Column 6,
Line 3, change ":size" to -- size --;
Line 47, change "sunction" to -- suction --.

Column 9,
Line 7, change "clark-color" to -- dark-color --;
Line 28, "41-1-41 L60" to --41-1-41-160 --.

Column 11,
Line 35, change "used ink" to -- ink used --;
Line 64, change "sunction" to -- suction --.

Column 13,
Line 7, change ":no" to -- no --.

Column 14,
Line 14, delete "be".
Line 60, change "second mode" to -- second recording mode --; and
Line 65, change "number" to -- numbers --.

Column 15,
Line 26, change "recoreding" to -- recording --.

Column 16,
Line 30, change "aid" to -- said --; and
Line 59, change "receptables" to -- receptacles --.

Column 17,
Line 1, change "sid" to -- said --.

UNITED STATES PATENT AND TRADEMARK OFFICE

CERTIFICATE OF CORRECTION

PATENT NO. : 6,095,637
DATED : August 1, 2000
INVENTOR(S) : Hiromitsu Hirabayashi et al.

It is certified that error appears in the above-identified patent and that said Letters Patent is hereby corrected as shown below:

Column 18,
Line 10, change "accoding" to -- according --.

Signed and Sealed this

Twenty fifth Day of December, 2001

*Attest:*

*Attesting Officer*

JAMES E. ROGAN
*Director of the United States Patent and Trademark Office*